US008221012B2

(12) United States Patent
Rennecker

(10) Patent No.: US 8,221,012 B2
(45) Date of Patent: Jul. 17, 2012

(54) RETRACTABLE INSTRUMENTS COMPRISING A ONE-PIECE VALVE DOOR ACTUATING ASSEMBLY

(75) Inventor: Daniel Rennecker, Chicago, IL (US)

(73) Assignee: Sanford, L.P., Oak Brook, IL (US)

( * ) Notice: Subject to any disclaimer, the term of this patent is extended or adjusted under 35 U.S.C. 154(b) by 620 days.

(21) Appl. No.: 12/266,680

(22) Filed: Nov. 7, 2008

(65) Prior Publication Data

US 2010/0119288 A1 May 13, 2010

(51) Int. Cl.
*B43K 24/02* (2006.01)
*B43K 5/16* (2006.01)
*B43K 7/12* (2006.01)

(52) U.S. Cl. ..... 401/99; 401/107; 401/108; 401/112

(58) Field of Classification Search ..... 401/99, 401/107–112
See application file for complete search history.

(56) References Cited

U.S. PATENT DOCUMENTS

| | | | |
|---|---|---|---|
| 1,810,249 | A | 6/1931 | Koehler |
| 1,923,634 | A | 8/1933 | Markstein |
| 1,940,548 | A | 12/1933 | Jensen |
| 2,073,719 | A | 3/1937 | Ross |
| 2,224,470 | A | 12/1940 | Boust |
| 2,291,859 | A | 8/1942 | Andrews |
| 2,392,840 | A | 1/1946 | Groft |
| 2,401,711 | A | 6/1946 | Smith |
| 2,603,186 | A | 7/1952 | Fischer |
| 2,626,049 | A | 1/1953 | Tursky |
| 2,874,679 | A | 2/1959 | Zepelovitch |
| 2,949,887 | A | 8/1960 | Martin et al. |
| 2,957,452 | A | 10/1960 | Brannon |
| 3,035,299 | A | 5/1962 | Gordon et al. |
| 3,124,106 | A | 3/1964 | Kosta |
| 3,146,758 | A | 9/1964 | Zepell |
| 3,169,511 | A | 2/1965 | Spatz |
| 3,292,593 | A | 12/1966 | Furuya |
| 3,480,370 | A | 11/1969 | Koeln |
| 3,525,573 | A | 8/1970 | Fend |
| 3,583,820 | A | 6/1971 | Koeln |
| 3,594,091 | A | 7/1971 | Bleuer |
| 3,617,138 | A | 11/1971 | Fukui et al. |
| 3,637,316 | A | 1/1972 | Bross et al. |
| 3,733,139 | A | 5/1973 | Neidhardt et al. |

(Continued)

FOREIGN PATENT DOCUMENTS

| | | |
|---|---|---|
| DE | 451 884 | 11/1927 |

(Continued)

OTHER PUBLICATIONS

Photograph A, Boone Marker, capped.

(Continued)

*Primary Examiner* — Tuan N Nguyen
(74) *Attorney, Agent, or Firm* — Marshall, Gerstein & Borun LLP

(57) ABSTRACT

An instrument includes an instrument body having an opening at one end. A valve is mounted within the instrument body, the valve having an opening at one end. A lid is integrally molded with the valve and hingedly movable with respect to the valve opening. An actuating arm is operatively connected to the lid, the actuating arm transmitting forces from an instrument movement mechanism to the valve door under both tension and compression. As a result, the lid is opened and closed substantially solely by the actuating arm.

20 Claims, 8 Drawing Sheets

U.S. PATENT DOCUMENTS

| | | | |
|---|---|---|---|
| 3,813,176 | A | 5/1974 | Kamo |
| 3,895,632 | A | 7/1975 | Plowiecki et al. |
| 3,941,488 | A | 3/1976 | Maxwell |
| 3,944,371 | A | 3/1976 | Schenk |
| 3,945,734 | A | 3/1976 | Woodbridge |
| 3,955,893 | A | 5/1976 | Pulaski |
| 3,985,455 | A | 10/1976 | Wahlberg |
| 4,022,535 | A | 5/1977 | Ritter |
| 4,115,015 | A | 9/1978 | Torii et al. |
| 4,161,374 | A | 7/1979 | Koeln et al. |
| 4,177,814 | A | 12/1979 | Knepshield et al. |
| 4,218,154 | A | 8/1980 | Erfer |
| 4,221,490 | A | 9/1980 | Malm |
| 4,269,525 | A | 5/1981 | Melikian |
| 4,315,695 | A | 2/1982 | Alves dos Santos et al. |
| 4,318,340 | A | 3/1982 | Shenoha et al. |
| 4,416,392 | A | 11/1983 | Smith |
| 4,469,462 | A | 9/1984 | Hashimoto et al. |
| 4,479,732 | A | 10/1984 | Shimizu et al. |
| 4,533,271 | A | 8/1985 | Sansevero |
| 4,540,300 | A | 9/1985 | Midorikawa et al. |
| 4,549,827 | A | 10/1985 | Mack |
| 4,560,297 | A | 12/1985 | Leem et al. |
| 4,575,271 | A | 3/1986 | Hashimoto et al. |
| 4,580,918 | A | 4/1986 | Baker et al. |
| 4,618,280 | A | 10/1986 | Kageyama et al. |
| 4,629,348 | A | 12/1986 | Hashimoto et al. |
| 4,667,828 | A | 5/1987 | Samuelson |
| 4,711,592 | A | 12/1987 | Gregory |
| 4,738,724 | A | 4/1988 | Wittwer et al. |
| 4,738,817 | A | 4/1988 | Wittwer et al. |
| 4,759,650 | A | 7/1988 | Granoff |
| 4,768,529 | A | 9/1988 | Mahruki et al. |
| 4,770,320 | A | 9/1988 | Miles et al. |
| 4,796,781 | A | 1/1989 | Windorski |
| 4,812,069 | A | 3/1989 | White et al. |
| 4,812,299 | A | 3/1989 | Wason |
| 4,815,881 | A | 3/1989 | Chern |
| 4,859,103 | A | 8/1989 | Wittek et al. |
| 4,863,796 | A | 9/1989 | Wason |
| 4,879,058 | A | 11/1989 | Wason |
| 4,879,323 | A | 11/1989 | Wason |
| 4,896,983 | A | 1/1990 | Im et al. |
| 4,902,657 | A | 2/1990 | Wason |
| 4,902,729 | A | 2/1990 | Wason |
| 4,904,101 | A | 2/1990 | Petterson |
| 4,907,825 | A | 3/1990 | Miles et al. |
| 4,911,570 | A | 3/1990 | Rhoades |
| 4,921,127 | A | 5/1990 | Windorski |
| 4,933,387 | A | 6/1990 | Wason |
| 4,937,078 | A | 6/1990 | Mezei et al. |
| 4,954,468 | A | 9/1990 | Wason |
| 4,957,233 | A | 9/1990 | Samuelson |
| 4,968,728 | A | 11/1990 | Wason |
| 4,969,764 | A | 11/1990 | Gregory |
| 4,974,980 | A | 12/1990 | Gueret et al. |
| 4,986,440 | A | 1/1991 | Windorski |
| 4,989,801 | A | 2/1991 | Thomas et al. |
| 4,993,590 | A | 2/1991 | Windorski |
| 5,015,111 | A | 5/1991 | Petterson |
| 5,022,773 | A | 6/1991 | Waldinger et al. |
| 5,022,775 | A | 6/1991 | Inoue et al. |
| 5,024,547 | A | 6/1991 | Mui et al. |
| 5,026,189 | A | 6/1991 | Keil et al. |
| 5,048,990 | A | 9/1991 | Hashimoto et al. |
| 5,059,435 | A | 10/1991 | Sloan et al. |
| 5,072,686 | A | 12/1991 | Falco |
| 5,080,255 | A | 1/1992 | Windorski |
| 5,090,955 | A | 2/1992 | Simon |
| D324,542 | S | 3/1992 | Lin |
| 5,092,701 | A | 3/1992 | Lai et al. |
| 5,158,205 | A | 10/1992 | Bodziak et al. |
| 5,165,570 | A | 11/1992 | Windorski et al. |
| 5,167,346 | A | 12/1992 | Bodziak |
| 5,174,814 | A | 12/1992 | Burwell et al. |
| 5,184,908 | A | 2/1993 | Yamamoto et al. |
| 5,207,523 | A | 5/1993 | Wittek |
| 5,336,006 | A | 8/1994 | Badr et al. |
| 5,342,135 | A | 8/1994 | Tucker |
| 5,342,136 | A | 8/1994 | Fukami et al. |
| 5,358,864 | A | 10/1994 | van den Broeck et al. |
| 5,372,580 | A | 12/1994 | Simon et al. |
| 5,411,168 | A | 5/1995 | Merten et al. |
| 5,420,615 | A | 5/1995 | Witz et al. |
| 5,426,456 | A | 6/1995 | Kuelzer et al. |
| 5,439,626 | A | 8/1995 | Bennett et al. |
| 5,454,655 | A | 10/1995 | Chiswell |
| 5,517,218 | A | 5/1996 | Lehna et al. |
| 5,547,301 | A | 8/1996 | Kageyama et al. |
| 5,547,468 | A | 8/1996 | Simon et al. |
| 5,553,956 | A | 9/1996 | Mitsuya et al. |
| 5,599,122 | A | 2/1997 | Yu |
| 5,604,036 | A | 2/1997 | Price et al. |
| 5,605,402 | A | 2/1997 | Uggetti et al. |
| 5,607,437 | A | 3/1997 | Simon et al. |
| 5,610,046 | A | 3/1997 | van Ooyen et al. |
| 5,643,660 | A | 7/1997 | Price et al. |
| 5,651,627 | A | 7/1997 | Dowzall et al. |
| 5,653,725 | A | 8/1997 | Simon et al. |
| 5,670,014 | A | 9/1997 | Mendelovich et al. |
| 5,672,021 | A | 9/1997 | Abber et al. |
| 5,676,481 | A | 10/1997 | Nicoll et al. |
| 5,697,518 | A | 12/1997 | Callahan, Jr. |
| 5,769,270 | A | 6/1998 | Fujisawa et al. |
| 5,813,787 | A | 9/1998 | Dowzall et al. |
| 5,823,697 | A | 10/1998 | Talbot et al. |
| D400,581 | S | 11/1998 | Hasegawa |
| 5,829,904 | A | 11/1998 | Matsumoto et al. |
| 5,849,559 | A | 12/1998 | Van Der Wouw et al. |
| 5,855,442 | A | 1/1999 | Keller |
| 5,865,553 | A | 2/1999 | Flye Sainte Marie et al. |
| 5,871,294 | A | 2/1999 | Turner |
| 5,871,296 | A | 2/1999 | Furukawa et al. |
| 5,891,398 | A | 4/1999 | Lewis et al. |
| 5,899,618 | A | 5/1999 | Kobayashi et al. |
| 5,904,806 | A | 5/1999 | Mendelovich et al. |
| 5,906,446 | A | 5/1999 | McCulloch et al. |
| 5,915,867 | A | 6/1999 | Hashimoto et al. |
| 5,927,881 | A | 7/1999 | Yang |
| 5,927,882 | A | 7/1999 | Kageyama et al. |
| 5,927,883 | A | 7/1999 | Lebauer |
| 5,929,051 | A | 7/1999 | Ni et al. |
| 5,931,846 | A | 8/1999 | Simon et al. |
| 5,957,603 | A | 9/1999 | Bell |
| 5,961,703 | A | 10/1999 | Fraas et al. |
| 5,967,688 | A | 10/1999 | Hu et al. |
| D417,206 | S | 11/1999 | Hirota |
| 6,019,535 | A | 2/2000 | Turner |
| 6,027,271 | A | 2/2000 | Barosso et al. |
| 6,033,141 | A | 3/2000 | Blaustein et al. |
| 6,048,121 | A | 4/2000 | Carver |
| 6,066,356 | A | 5/2000 | Van Der Wouw et al. |
| 6,089,776 | A | 7/2000 | Kaufmann et al. |
| 6,095,707 | A | 8/2000 | Kaufmann et al. |
| 6,099,924 | A | 8/2000 | Nakamaki et al. |
| 6,106,179 | A | 8/2000 | Kuo |
| 6,120,204 | A | 9/2000 | Rigoni |
| 6,120,751 | A | 9/2000 | Unger |
| 6,135,660 | A | 10/2000 | Stevens et al. |
| 6,155,733 | A | 12/2000 | Holbrook et al. |
| 6,158,913 | A | 12/2000 | Dumler et al. |
| 6,170,318 | B1 | 1/2001 | Lewis |
| 6,210,768 | B1 | 4/2001 | Blok et al. |
| 6,213,661 | B1 | 4/2001 | Coon |
| 6,231,257 | B1 | 5/2001 | Stevens et al. |
| 6,244,744 | B1 | 6/2001 | Calvin |
| 6,244,774 | B1 | 6/2001 | Barosso et al. |
| 6,261,019 | B1 | 7/2001 | Furukawa et al. |
| D446,213 | S | 8/2001 | Chen et al. |
| 6,283,661 | B1 | 9/2001 | Connors |
| 6,306,598 | B1 | 10/2001 | Charych et al. |
| 6,347,898 | B1 | 2/2002 | Rhodes et al. |
| 6,350,369 | B1 | 2/2002 | Lewis et al. |
| 6,354,754 | B1 | 3/2002 | Pan |
| 6,371,673 | B1 | 4/2002 | Gueret |
| D457,185 | S | 5/2002 | Ham |
| 6,398,178 | B1 | 6/2002 | Azola et al. |

6,409,408 B2 6/2002 Koyama et al.
D460,484 S 7/2002 Bianco, Jr.
D460,982 S 7/2002 Bianco, Jr.
6,416,242 B1 7/2002 Kaufmann et al.
6,417,121 B1 7/2002 Newkirk et al.
6,417,122 B1 7/2002 Newkirk et al.
6,420,285 B1 7/2002 Newkirk et al.
6,433,012 B1 8/2002 Tuse et al.
6,468,759 B1 10/2002 Charych
6,478,495 B2 11/2002 Ami et al.
6,482,517 B1 11/2002 Anderson
6,497,524 B1 12/2002 Kim
6,505,984 B2 1/2003 Smith et al.
D471,233 S 3/2003 Geiselhart et al.
D472,578 S 4/2003 Plantz et al.
6,540,422 B2 4/2003 Torii
6,554,516 B1 4/2003 Christopher
6,554,517 B2 4/2003 Ahmed
6,561,713 B2 5/2003 Sukhna et al.
6,565,275 B2 5/2003 Brand et al.
6,565,763 B1 5/2003 Asakawa et al.
6,588,958 B1 7/2003 Seidler
6,605,344 B1 8/2003 Ohba et al.
6,607,325 B2 8/2003 Hori et al.
6,631,333 B1 10/2003 Lewis et al.
6,638,621 B2 10/2003 Anderson
6,644,880 B2 11/2003 Duez et al.
6,648,539 B2 11/2003 Dai et al.
6,656,319 B1 12/2003 Boyd et al.
D487,113 S 2/2004 Kent
D489,087 S 4/2004 Kent
6,719,472 B2 4/2004 Windorski et al.
6,723,394 B1 4/2004 Sirringhaus et al.
6,752,557 B1 6/2004 Hsieh et al.
6,755,584 B2 6/2004 O'Brien et al.
D497,180 S 10/2004 Cetera
D497,387 S 10/2004 Cetera
D501,509 S 2/2005 Lecce
6,866,436 B2 3/2005 Kanari et al.
6,927,256 B2 8/2005 Stevens et al.
6,964,534 B2 11/2005 Brand et al.
6,967,102 B1 11/2005 Anderson et al.
6,974,697 B2 12/2005 Comer et al.
6,977,244 B2 12/2005 Tormo et al.
6,979,456 B1 12/2005 Parikh et al.
6,979,558 B2 12/2005 Harris, Jr. et al.
6,979,559 B2 12/2005 Harris, Jr. et al.
6,981,812 B1 1/2006 Hsieh et al.
6,989,007 B2 1/2006 Shadduck
6,989,195 B2 1/2006 Anderson
6,991,514 B1 1/2006 Meloni et al.
7,004,945 B2 2/2006 Boyd et al.
7,008,633 B2 3/2006 Yang et al.
7,018,838 B2 3/2006 Murphy et al.
7,022,683 B1 4/2006 Ni et al.
7,037,015 B1 5/2006 Witz et al.
7,037,657 B2 5/2006 Le et al.
7,048,963 B2 5/2006 Braithwaite et al.
7,059,796 B2 6/2006 Lewis, Jr. et al.
7,060,754 B2 6/2006 Stevens et al.
7,101,102 B2 9/2006 Sawa et al.
7,220,073 B2 5/2007 Yoon et al.
7,322,766 B2 1/2008 Erlebacher et al.
7,329,062 B2 2/2008 Brand et al.
7,331,730 B2 2/2008 Fukui et al.
7,341,388 B2 3/2008 Carroll
7,350,996 B2 4/2008 Bielecki et al.
7,465,112 B2 12/2008 Qiu et al.
7,488,130 B2 2/2009 Dylkiewicz et al.
2002/0010510 A1 1/2002 Silvestrini
2002/0029084 A1 3/2002 Paul et al.
2002/0081139 A1 6/2002 Legg
2002/0081232 A1 6/2002 Lewis et al.
2002/0131807 A1 9/2002 Ami et al.
2002/0142477 A1 10/2002 Lewis et al.
2002/0159817 A1 10/2002 Brand et al.
2002/0159818 A1 10/2002 Smith et al.
2002/0172544 A1 11/2002 Dai
2002/0192007 A1 12/2002 Lee
2003/0000958 A1 1/2003 Windorski et al.
2003/0068191 A1 4/2003 Hori
2003/0108377 A1 6/2003 Duez et al.
2003/0108743 A1 6/2003 Anderson
2003/0138283 A1 7/2003 O'Brien et al.
2003/0195300 A1 10/2003 Stevens et al.
2003/0210945 A1 11/2003 Noguchi
2003/0210947 A1 11/2003 Calendrille et al.
2003/0211130 A1 11/2003 Sanders et al.
2003/0215281 A1 11/2003 Sexton et al.
2003/0222048 A1 12/2003 Asakawa et al.
2004/0028875 A1 2/2004 Van Rijn et al.
2004/0037609 A1 2/2004 Kageyama
2004/0050816 A1 3/2004 Asakawa et al.
2004/0062879 A1 4/2004 Bowman et al.
2004/0201117 A1 10/2004 Anderson
2004/0213627 A1 10/2004 Marschand et al.
2004/0234326 A1 11/2004 Erlebacher et al.
2004/0265035 A1 12/2004 Brand et al.
2004/0265039 A1 12/2004 Buck
2005/0004578 A1 1/2005 Lambrecht et al.
2005/0019112 A1 1/2005 Erickson et al.
2005/0043470 A1 2/2005 Stevens et al.
2005/0047844 A1 3/2005 Lammers et al.
2005/0058497 A1 3/2005 Marschand
2005/0074268 A1 4/2005 Beil
2005/0079003 A1 4/2005 Buck et al.
2005/0084320 A1 4/2005 Carroll
2005/0084321 A1 4/2005 Carroll
2005/0089656 A1 4/2005 Shiina
2005/0115690 A1 6/2005 Bohlig
2005/0191112 A1 9/2005 Yoon
2005/0196580 A1 9/2005 Provost et al.
2005/0196583 A1 9/2005 Provost et al.
2005/0208259 A1 9/2005 Provost et al.
2005/0217092 A1 10/2005 Barker et al.
2005/0221271 A1 10/2005 Murphy et al.
2005/0246023 A1 11/2005 Yeung
2005/0250181 A1 11/2005 Schroder Glad et al.
2005/0256253 A1 11/2005 Parker et al.
2005/0265774 A1 12/2005 Albisetti
2005/0271451 A1 12/2005 Brand et al.
2006/0002755 A1 1/2006 Sawa
2006/0002852 A1 1/2006 Saltzman et al.
2006/0002971 A1 1/2006 Saltzman et al.
2006/0004193 A1 1/2006 Muller et al.
2006/0004314 A1 1/2006 McCarthy et al.
2006/0019339 A1 1/2006 Lauth et al.
2006/0036269 A1 2/2006 Schachar et al.
2006/0051274 A1 3/2006 Wright et al.
2006/0051451 A1 3/2006 Hutchinson et al.
2006/0051735 A1 3/2006 Fuhr et al.
2006/0058383 A1 3/2006 Huang et al.
2006/0062780 A1 3/2006 Zocher et al.
2006/0063882 A1 3/2006 Velev et al.
2006/0065992 A1 3/2006 Hutchinson et al.
2006/0069230 A1 3/2006 Papisov
2006/0073159 A1 4/2006 Vonderheide et al.
2006/0073294 A1 4/2006 Hutchinson et al.
2006/0073298 A1 4/2006 Hutchinson et al.
2006/0073333 A1 4/2006 Anderson
2006/0084034 A1 4/2006 Hochman
2006/0088897 A1 4/2006 Lim et al.
2006/0095066 A1 5/2006 Chang et al.
2006/0099244 A1 5/2006 Guilford
2006/0106408 A1 5/2006 Schachar et al.
2006/0106409 A1 5/2006 Schachar et al.
2006/0110439 A1 5/2006 Tobia et al.
2006/0115462 A1 6/2006 Subbotin et al.
2006/0116712 A1 6/2006 Sepetka et al.
2006/0116713 A1 6/2006 Sepetka et al.
2006/0121608 A1 6/2006 Comer et al.
2006/0216103 A1 9/2006 Bielecki et al.
2007/0172300 A1 7/2007 Wlodarczyk
2008/0131188 A1 6/2008 Breuer et al.
2008/0138139 A1 6/2008 Kageyama
2008/0175648 A1 7/2008 Hayes et al.
2008/0193194 A1 8/2008 Yoon
2008/0298878 A1 12/2008 Hui

FOREIGN PATENT DOCUMENTS

| | | | |
|---|---|---|---|
| DE | 623 816 | | 12/1935 |
| DE | 1 259 732 | | 1/1968 |
| DE | 26 49 230 | | 4/1978 |
| DE | 34 38 074 | | 4/1986 |
| DE | 88 05 298 | | 8/1989 |
| DE | 88 06 917 | U1 | 11/1989 |
| DE | 89 00 030 | U | 5/1990 |
| DE | 295 10 975 | | 9/1995 |
| DE | 33 41 759 | A1 | 11/1997 |
| DE | 297 09 080 | U1 | 10/1998 |
| DE | 100 30 440 | A1 | 1/2002 |
| DE | 103 26 926 | A1 | 1/2005 |
| EP | 0 150 557 | | 8/1985 |
| EP | 0 267 557 | | 5/1988 |
| EP | 0267557 | A1 | 5/1988 |
| EP | 0 316 007 | | 5/1989 |
| EP | 0 354 823 | | 2/1990 |
| EP | 0 400 272 | | 12/1990 |
| EP | 0 416 181 | A1 | 3/1991 |
| EP | 0 469 465 | | 2/1992 |
| EP | 0 545 917 | | 6/1993 |
| EP | 0 586 792 | | 3/1994 |
| EP | 0 667 818 | | 8/1995 |
| EP | 0 703 096 | | 3/1996 |
| EP | 0 711 673 | | 5/1996 |
| EP | 0 822 098 | | 2/1998 |
| EP | 0 899 128 | | 3/1999 |
| EP | 1 050 417 | | 11/2000 |
| EP | 1 354 722 | A2 | 10/2003 |
| EP | 1 600 078 | | 11/2005 |
| EP | 1955869 | A2 | 8/2008 |
| FR | 1.424.492 | | 1/1966 |
| FR | 2.220.353 | | 10/1974 |
| FR | 2907371 | | 4/2008 |
| GB | 243110 | | 11/1925 |
| GB | 937632 | | 9/1963 |
| GB | 2 106 044 | | 4/1983 |
| GB | 2 325 649 | A | 12/1998 |
| JP | 58-009788 | | 1/1983 |
| JP | 58-153081 | | 9/1983 |
| JP | 60-119588 | | 6/1985 |
| JP | 1-280596 | | 11/1989 |
| JP | 1-281999 | | 11/1989 |
| JP | 2-041992 | | 3/1990 |
| JP | 2-108086 | | 4/1990 |
| JP | 2-283499 | | 11/1990 |
| JP | 4-043345 | | 2/1992 |
| JP | 4-316899 | | 11/1992 |
| JP | 6-035232 | | 2/1994 |
| JP | 6-216585 | | 8/1994 |
| JP | 7-242094 | | 9/1995 |
| JP | 7-290883 | | 11/1995 |
| JP | 7-329486 | | 12/1995 |
| JP | 8-072470 | | 3/1996 |
| JP | 8-108676 | | 4/1996 |
| JP | 8-216585 | | 8/1996 |
| JP | 8-258480 | | 10/1996 |
| JP | 8-282174 | | 10/1996 |
| JP | 8-282175 | | 10/1996 |
| JP | 9-131994 | | 5/1997 |
| JP | 10-100579 | | 4/1998 |
| JP | 10-114188 | | 5/1998 |
| JP | 11-139081 | A | 5/1999 |
| JP | 2000-025386 | A | 1/2000 |
| JP | 2003-128971 | | 5/2003 |
| JP | 2003-312185 | A | 11/2003 |
| JP | 2003-312186 | A | 11/2003 |
| JP | 2003-312188 | A | 11/2003 |
| KP | 2003-056790 | A | 7/2003 |
| KP | 2003-060260 | A | 7/2003 |
| KP | 2003-061516 | A | 7/2003 |
| WO | WO-90/00118 | | 1/1990 |
| WO | WO-93/12175 | | 6/1993 |
| WO | WO-93/17879 | | 9/1993 |
| WO | WO-94/11204 | | 5/1994 |
| WO | WO-94/11205 | | 5/1994 |
| WO | WO-94/25293 | | 11/1994 |
| WO | WO-95/07191 | | 3/1995 |
| WO | WO-96/39054 | | 12/1996 |
| WO | WO-98/06450 | | 2/1998 |
| WO | WO-99/11471 | | 3/1999 |
| WO | WO-01/28696 | | 4/2001 |
| WO | WO-01/64453 | | 9/2001 |
| WO | WO-02/06437 | | 1/2002 |
| WO | WO-02/13173 | | 2/2002 |
| WO | WO-02/064379 | | 8/2002 |
| WO | WO-03/002357 | A1 | 1/2003 |
| WO | WO-03/068530 | | 8/2003 |
| WO | WO-2005/009755 | | 2/2005 |
| WO | WO-2007/097602 | | 8/2007 |
| WO | WO-2007/126253 | | 11/2007 |
| WO | WO-2008/029993 | | 3/2008 |

OTHER PUBLICATIONS

Photograph B, Boone Marker, uncapped.
Photograph C, Colorific Retractable Marker, retracted.
Photograph D, Colorific Retractable Marker, extended.
Photograph E, Marks-A-Lot Retractable Marker, retracted.
Photograph F, Marks-A-Lot Retractable Marker, extended.
Photograph G, Sharpie RT Marker, retracted.
Photograph H, Sharpie RT Marker, extended.
Photograph I, Tokai Retractable Marker, retracted.
Photograph J, Tokai Retractable Marker, extended.
International Search Report corresponding to co-pending International Patent Application Serial No. PCT/US2006/011014; European Patent Office; dated Nov. 23, 2006; 2 pages.
International Search Report for International Patent Application No. PCT/US04/008490, dated Jan. 7, 2005.
Written Opinion for International Patent Application No. PCT/US04/008490, dated Jan. 7, 2005.
European Search Report for Application No. 09008302.3-2304/2189296, dated Oct. 27, 2011.
Photograph A, Boone Marker, capped. Available at least as early as Nov. 12, 2007.
Photograph B, Boone Marker, uncapped. Available at least as early as Nov. 12, 2007.
Photograph C, Colorific Retractable Marker, retracted. Available at least as early as Nov. 12, 2007.
Photograph D, Colorific Retractable Marker, extended. Available at least as early as Nov. 12, 2007.
Photograph E, Marks-A-Lot Retractable Marker, retracted. Available at least as early as Nov. 12, 2007.
Photograph F, Marks-A-Lot Retractable Marker, extended. Available at least as early as Nov. 12, 2007.
Photograph G, Sharpie RT Marker, retracted. Available at least as early as Nov. 12, 2007.
Photograph H, Sharpie RT Marker, extended. Available at least as early as Nov. 12, 2007.
Photograph I, Tokai Retractable Marker, retracted. Available at least as early as Nov. 12, 2007.
Photograph J, Tokai Retractable Marker, extended. Available at least as early as Nov. 12, 2007.

RETRACTABLE INSTRUMENTS COMPRISING A ONE-PIECE VALVE DOOR ACTUATING ASSEMBLY

BACKGROUND

1. Field of the Disclosure

The disclosure relates generally to retractable instruments and more specifically to cap-less, retractable writing instruments having a one-piece valve door actuating assembly.

2. Related Technology

One example of a cap-less, retractable writing instrument is shown in U.S. Pat. No. 5,048,990, which is hereby incorporated by reference. The cap-less writing instrument includes a writing member having a writing tip. The writing member is accommodated in a valve that is disposed inside a writing instrument body. A lid for closing an end opening of the valve is disposed on the valve near the front end thereof. A writing member moving mechanism moves the writing member forwardly and locks the writing member at a writing position with the writing tip protruding through the front of the writing instrument body. The moving mechanism includes separate flexible thread-like members that connect the writing member moving mechanism to the lid so that after the writing member is retracted, the lid is pulled backwardly so as to be brought into contact with the valve, thereby substantially sealing the writing member within the valve and preventing the writing tip from drying out. Because the prior art cap-less writing instrument uses flexible connecting members, the prior art cap-less writing instrument relies to some extent on the nib to push the lid to an open position during extension of the writing instrument at least until the lid is positioned such that the thread member can exert a backwardly directed force on same. As a result of this repeated contact between the nib and the lid, ink builds up on the inner surface of the lid. The uneven inner lid surface results in incomplete contact with the valve. This incomplete contact manifests as one or more breaches in the seal between the lid the valve, thereby allowing premature ink or solvent evaporation from the writing tip and lending to diminished performance of the entire assembly.

Some capless writing instruments incorporate more robust connecting members. One such writing instrument includes connecting members which are molded into a snap ring or seal seat and thus connect the snap ring to the lid. One example of a prior capless writing instrument is the Pentel NX50, which is currently available in Japan. However, in such writing instruments, the lid is a separate component from the valve body. Because the lid is separate component, such prior capless writing instruments use a complicated set of channels and tabs on the connecting members and/or the valve body to bias the lid open when protracting the writing instrument. During closing, it is easy for alignment between the lid and the valve to become displaced and for the lid to contact the valve in different orientations due to the separate components (i.e., there is no alignment mechanism between the lid and valve). As a result, over time, the lid can become worn and deformed and ultimately lose the ability to reliably seal the valve, thus leading to ink evaporation and premature drying of the nib.

SUMMARY OF THE DISCLOSURE

In one embodiment, an instrument comprises an instrument body having an opening at one end. A valve is mounted within the instrument body, the valve having an opening at one end. An integral valve door is hingedly mounted to the valve proximate the opening. An actuating arm is molded to either the valve door or a seat ring. The actuating arm transmits forces under both tension and compression, from an instrument actuating device to the valve door. Thus, the valve door is both opened and closed substantially solely by the actuating arm.

In another embodiment, a retractable writing instrument comprises a writing member having a nib, the nib extending through an opening in a reservoir holder. A valve substantially surrounds the opening and the valve has an open end. A movement mechanism moves the writing member from a retracted position in which the nib is disposed substantially within the valve to an extended position in which the nib is extended outside of the valve through the open end. A lid is integrally attached to the valve at the open end, the lid being movable from an open position in which the lid exposes the open end of the valve to a closed position in which the lid covers the open end of the valve. An actuating arm is attached to the movement mechanism and to the lid, the transfer mechanism transmitting forces under tension or compression, through the actuating arm to the lid. Thus, the lid is both opened and closed by substantially solely by the actuating arm and the nib does not contact the lid during extension or retraction.

BRIEF DESCRIPTION OF THE DRAWINGS

Exemplary aspects and features of an instrument constructed in accordance with the disclosure are described and explained in greater detail below with the aid of the drawing figures in which.

DETAILED DESCRIPTION

Figure 1:
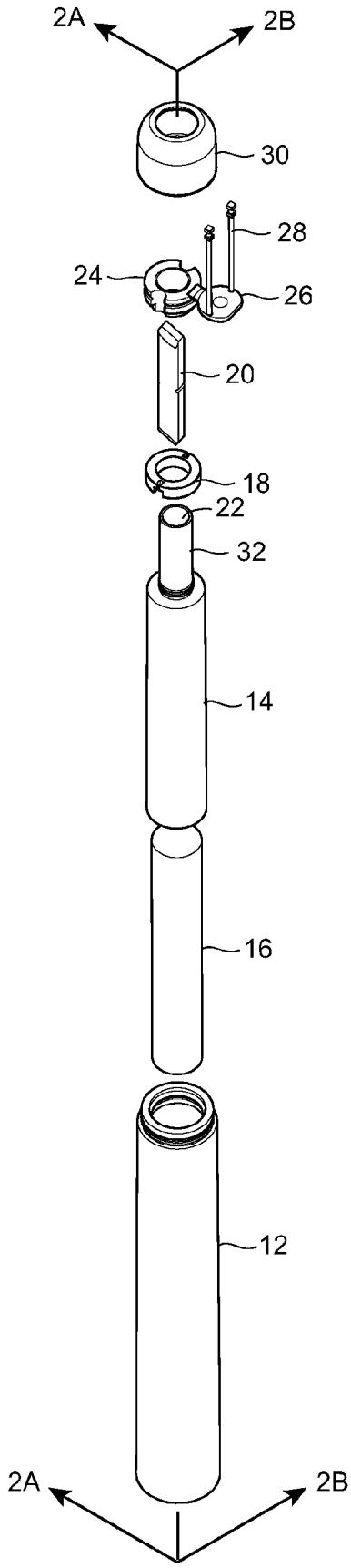
FIG. 1 is an exploded perspective view of a cap-less marker constructed in accordance with the teachings of the disclosure.

A cap-less writing instrument 10 generally constructed in accordance with the teachings of the disclosure is shown in FIG. 1. The illustrated writing instrument includes a barrel 12 that houses reservoir holder 14. The reservoir holder 14, in turn, holds a reservoir 16 for carrying ink. A snap ring (or spring seat) 18 is seated at one end of the reservoir holder 14. A nib 20 extends through the snap ring 18 and through an opening 22 on the reservoir holder 14 and contacts the reservoir 16. During writing, the nib 20 draws ink from the reservoir 16 through capillary action. A valve 24 is disposed over the nib 20 and a portion of the reservoir holder 14. A valve lid 26 is integrally molded and hingedly attached to the valve 24. The hinge is typically a living hinge and molded integrally with the valve 24 and lid 26. The valve 24 and valve lid 26 provide a seal around the nib 20 when the nib 20 is in a retracted position, thus preventing ink (or solvent contained therein) evaporation and premature drying of the nib 20. A pair of actuating arms 28 are molded to the lid 26. The actuating arms 28 provide opening and closing forces to the lid 26 from a spring or other force generating mechanism (not shown). The disclosed cap-less writing instrument does not rely on the nib 20 for lid opening forces as is the case with prior art cap-less writing instruments because the valve lid 26 is opened and closed substantially solely by the actuating arms 28. A nose 30 is coupled to the barrel 12 to provide protection for the valve 24 and lid 26 and to provide a user with a gripping surface.

Figure 2A:
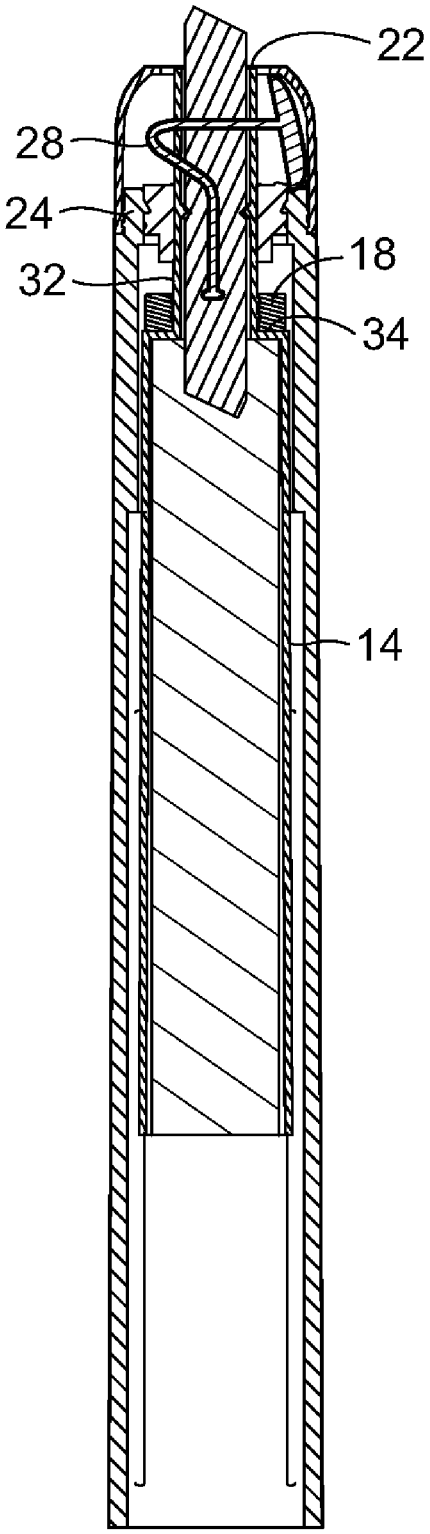
FIG. 2A is a cross-sectional view of the cap-less marker of FIG. 1.
Figure 2B:
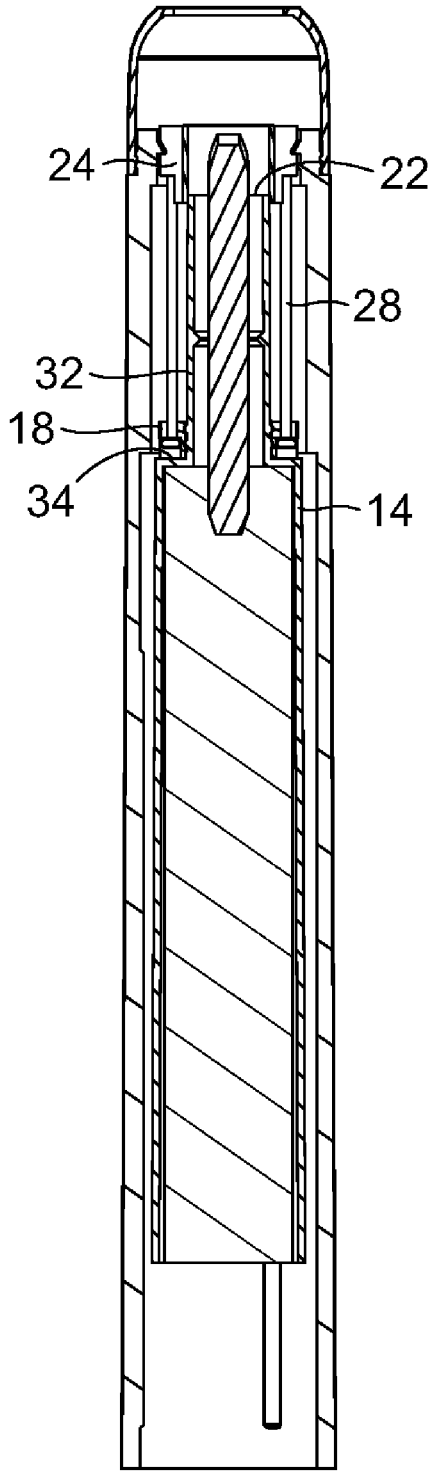
FIG. 2B is another cross-sectional view of the cap-less writing marker of FIG. 1 rotated approximately 90 degrees from the cross-sectional view of FIG. 2A.

Turning now to FIGS. 2A and 2B, the valve 24 surrounds the opening 22 of the reservoir holder 14. The opening 22 is located at one end of the reservoir holder 14 in an extension 32 that has a smaller outer diameter than the rest of the reservoir holder 14. One end of the extension 32 being part of the reservoir holder 14 thereby forming a shoulder 34. The extension 32 is disposed within an inner diameter of the snap ring 18. The snap ring 18 and the shoulder 34 form a seat for a spring (not shown) which generates opening and closing forces for protracting and retracting the writing instrument and the seal lid 26. The spring (not shown) is trapped between the snap ring 18 and the valve 24, which is disposed near the opening 22. Thus, the spring (not shown) transmits forces to the actuating arms 28, which in turn transmit those forces to the lid 26 thereby selectively opening and closing the lid 26. The valve 24 forms a seal with the extension 32 where the extension 32 meets the valve 24. At the other end of the valve 24, the valve lid 26 selectively closes the valve 24. As a result, the nib 20 is protected from the environment and ink (more specifically, the solvent contained therein) within the nib 20 is prevented from evaporating.

Figure 3A:
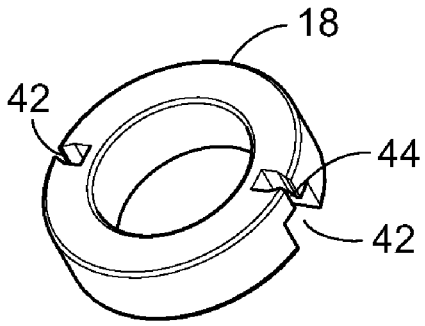
FIG. 3A is a. top perspective view a seat ring of the cap-less maker of FIG. 1
Figure 3B:
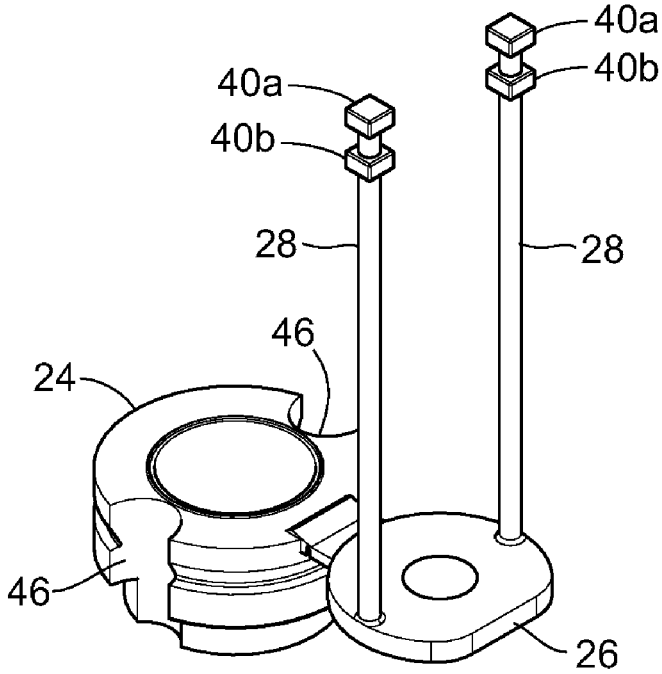
FIG. 3B is a top perspective view of a valve and lid of the cap-less marker of FIG. 1.

FIG. 3B is a close up view of the valve 24 and lid 26. In this embodiment, the actuating arms 28 are molded into the lid 26. However, the actuating arms 28 may be molded to the snap ring 18, as discussed hereinafter, or to both the lid 26 and the snap ring 18. As a result, a valve actuating assembly is formed which requires less parts and less assembly time as compared to valves of prior art cap-less writing instruments. At ends opposite the lid 26, the actuating arms 28 may have one or more stops 40*a*, 40*b*. The illustrated stops 40*a*, 40*b* can connect the actuating arms 28 to the snap ring 18 shown in FIG. 3A. The snap ring 18 includes one or more slots 42. During assembly, the stops 40*a*, 40*b* may be inserted laterally into a lower portion of the slot 42. As a result, a neck 44 of the slot 42 may become trapped between the stops 40*a*, 40*b* and the actuating arms 28 become capable of transmitting forces from the snap ring 18 to the valve lid 26. This slot and stop connection reduces assembly time thus increasing manufacturing efficiency over prior capless writing instruments that used flexible actuating members such as monofilament strings.

The valve 24 includes one or more stabilizing features, manifested in this embodiment as recessed guides 46. In the assembled condition, the actuating arms 28 may be disposed substantially within the guides 46. The guides 46 protect the actuating arms 28 from possible entanglement with the spring (not shown) which is a common problem in prior art designs. Additionally, the guides 46 provide lateral support to the actuating arms during opening of the lid 26. For example, any portion of the actuating arm 28 that remains within the guide 46 is effectively prevented from buckling or deforming under compressive loads. The guides 46 aid in sequenced opening of the lid 26 which will be discussed hereinafter.

Figure 4:
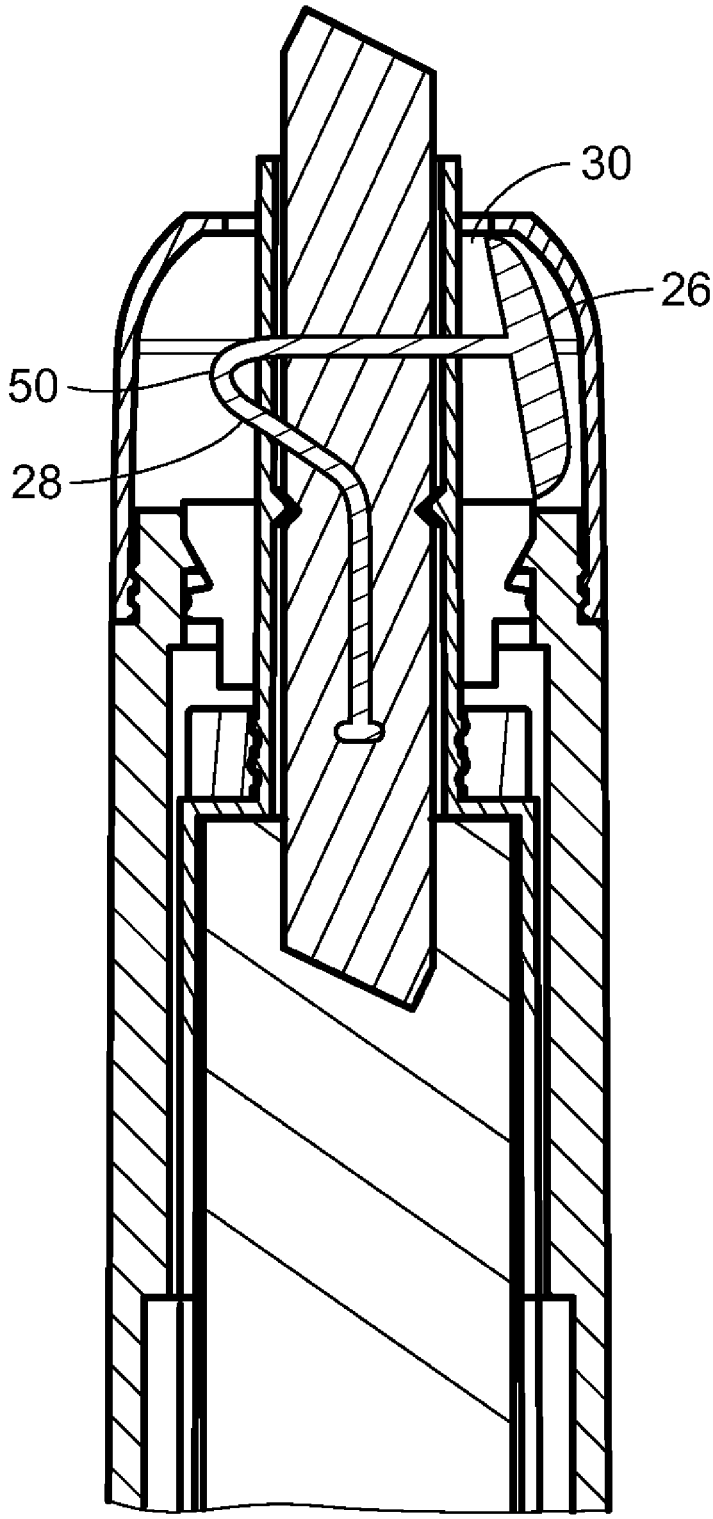
FIG. 4 is a close up cross-sectional view of the valve and lid of the cap-less marker of FIG. 1 with the lid in an open position.
Figure 5:
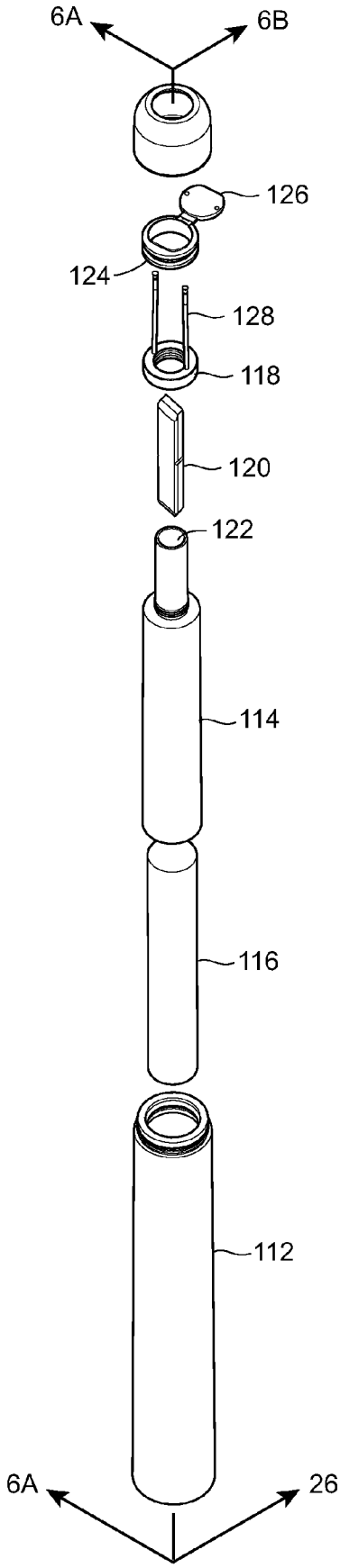
FIG. 5 is an exploded perspective view of an alternative embodiment of a cap-less marker constructed in accordance with the teachings of the disclosure.
Figure 6A:
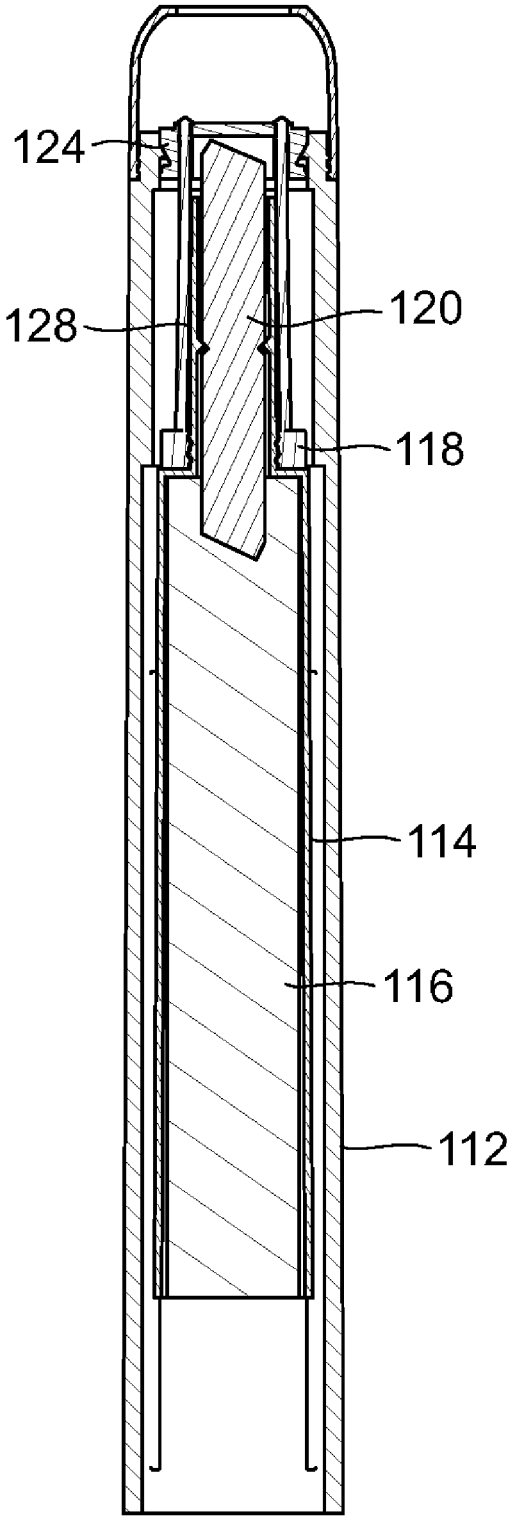
FIG. 6A is a cross-sectional view of the cap-less marker of FIG. 5.
Figure 6B:
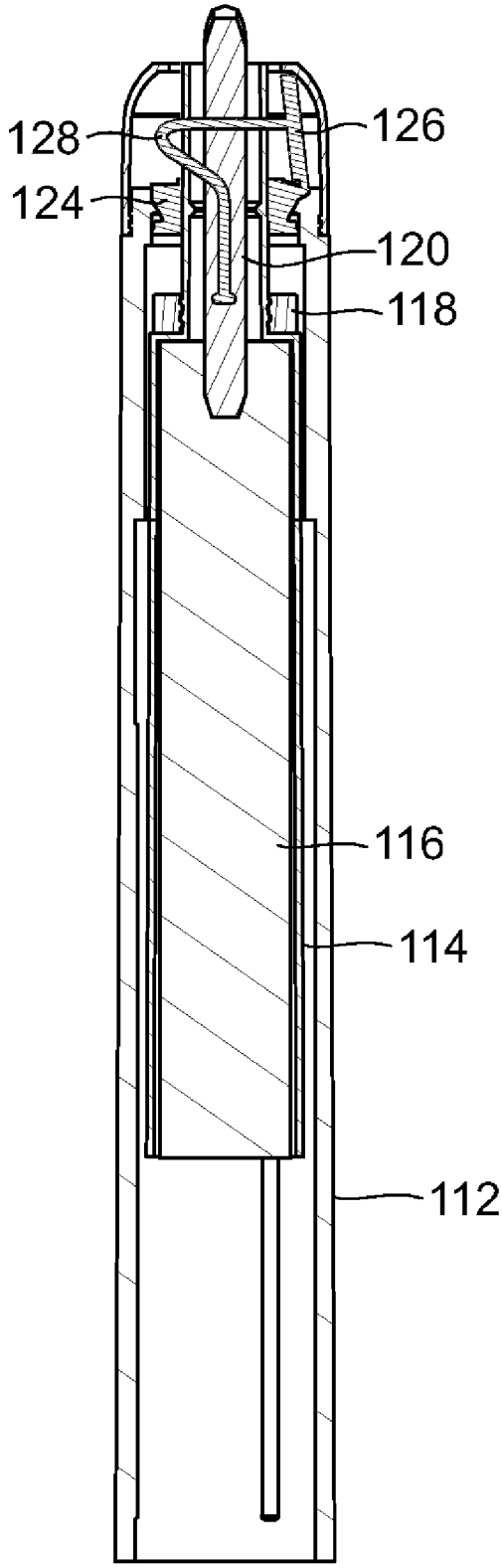
FIG. 6B is another cross-sectional view of the cap-less writing marker of FIG. 5 rotated approximately 90 degrees from the cross-sectional view of FIG. 5A.

Turning now to FIG. 4, the lid 26 is shown in an open condition. The actuating arms 28 have predictably deformed due to a geometric feature 50, such as a thinning of the actuating arms 28, or a notch in the actuating arms 28. Optionally, two or more geometric features 50 may be included on the actuating arms 28 to create multiple stages or sequences of lid 26 opening. Selective thinning of the actuator arms 28 is not possible with prior art actuators such as monofilaments or other thread-like members. The geometric feature 50 locally weakens the actuating arms 28 so that the actuating arms 28 experience deformation in the vicinity of the geometric feature 50 before any other part of the actuating arms 28 begin to deform. Thus the amount, location, and timing of deformation may be controlled such that the lid 26 is sequentially opened. In this manner, the lid 26 is not subject to 1) contact from the nib 20; or 2) contact with the instrument body because the deformation of the actuating arms 28 effectively reduces the overall distance the lid 26 moves compared to the distance the snap ring moves. As a result, the actuating arms 28 can open the lid 26 and stop the opening motion before the lid 26 contacts an inside of the instrument body. Thus, the lid 26 and actuator arms 28 may have a longer lifespan than prior art designs.

The guides 46 support the geometric feature 50 as long as the geometric feature 50 is disposed substantially within the guides 46. As a result, the actuating arms 28 do not begin to deform or buckle as shown in FIG. 4 until the geometric feature 50 extends above the guides 46. Once the geometric feature 50 is above the guides 46, the actuating arms 28 begin to deform such that some of the upward movement of the actuating arms 28 is translated into lateral movement. Thus, the lid 26 opens more quickly (because all of the upward movement of the actuating arms 28 is directed to upward movement of the lid) when the geometric feature 50 is disposed within the guides 46, and the lid opens more slowly (because some of the upward movement of the actuating arms 28 is converted into lateral movement) when the geometric feature 50 is located outside of the guides 46. Another result of the deformation of the actuating arms 28 is a much shorter nose 30. Because the actuating arms 28 are not linear when the lid 26 is opened (i.e., the actuating arms 28 have buckled in the vicinity of the geometric feature 50), the nose 30 may be smaller than prior art noses resulting in a material savings and a shorter instrument overall. It should be understood that while actuating arms including a geometric feature are generally preferred, this feature is optional.

Another embodiment of a cap-less writing instrument 110 is shown in FIGS. 5-7B. Reference numerals for like parts are shown as exactly 100 greater that the embodiment shown in FIGS. 1-3B. The cap-less writing instrument 110 generally includes a barrel 112 that houses reservoir holder 114. The reservoir holder 114, in turn, holds a reservoir 116 for carrying ink. A snap ring (or spring seat) 118 is seated at one end of the reservoir holder 114. A nib 120 extends through the snap ring 118 and through an opening 122 on the reservoir holder 114 and contacts the reservoir 116. A valve 124 is disposed over the nib 120 and a portion of the reservoir holder 114. A valve lid 126 is integrally molded and hingedly attached to the valve 124. The hinge is typically a living hinge and molded integrally with the valve 124 and lid 126. In this embodiment, a pair of actuating arms 128 is molded to the snap ring 118 as opposed to the embodiment of FIGS. 1-3B where the actuating arms were molded to the lid 26.

Figure 7A:
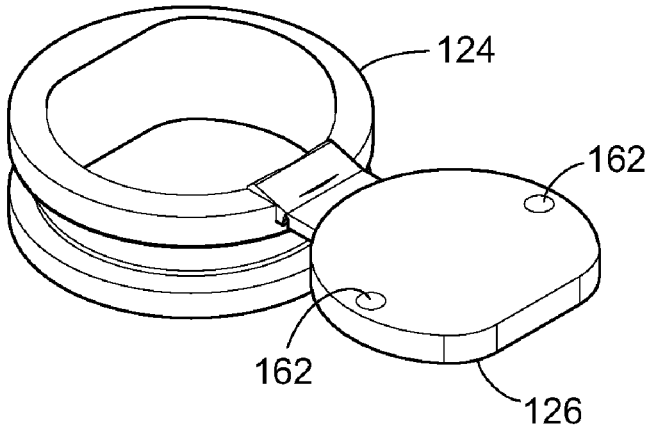
FIG. 7A is a top perspective view of the valve and lid of the cap-less marker of FIG. 5.
Figure 7B:
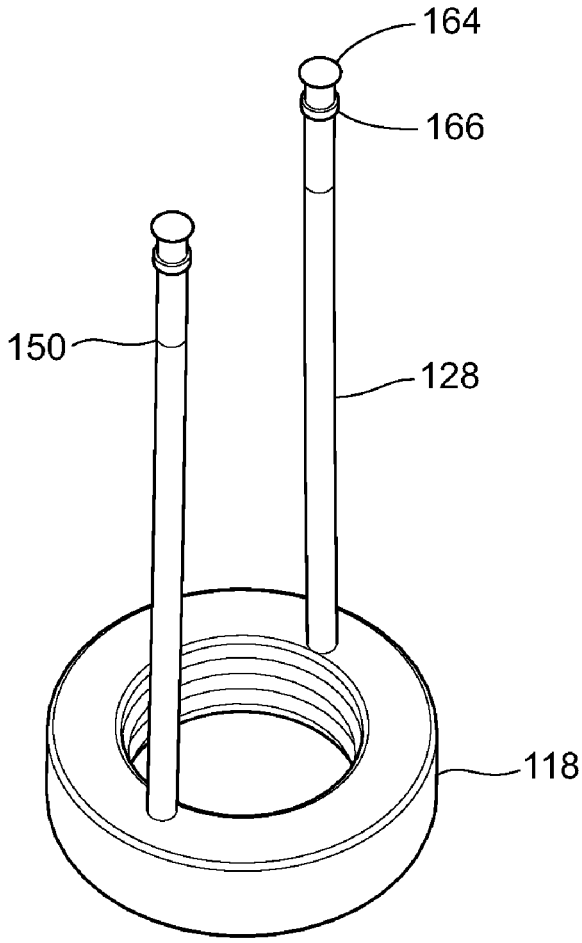
FIG. 7B is a top perspective view a seat ring of the cap-less maker of FIG. 5.

FIG. 7A shows a close up perspective view of the valve 124 and the lid 126. The valve 124 includes one or more stabilizing features that manifest as openings 162 which extend through the lid 126 from a top lid surface to a bottom lid surface in this embodiment. Although the openings 162 are shown as circular in shape, the openings 162 can be virtually any shape, such as, for example, square, rectangular, oval, triangular, etc. The openings 162 are shaped and sized to receive ends of the actuator arms 128. The openings protect the actuating arms 128 by spacing the actuating arms 128 away from an inner surface of the valve 124. As seen in FIG. 7B, the actuator arms 128 of this embodiment are integral to the snap ring 118 (e.g., integrally molded to the snap ring 118). The actuator arms 128 include a tapered head 164 opposite the snap ring 118. The actuator arms 128 also include a stop 166 positioned between the head 164 and the snap ring 118. During assembly, the head 164 is pushed through the opening 162 thus securing the actuating arms 128 to the valve lid 126. The actuating arms 128 are protected from entanglement with an actuating spring (not shown) which generally is disposed about the extension 32 because the actuating arms 128 are disposed inside the valve 124. Moreover, the openings 162 support the actuating arms 128 during opening and closing of the lid 126. The actuating arms 128 of this embodiment may optionally also include geometric features 150 similar to the geometric features 50 of the embodiment of FIGS. 1-3B. The actuating arms 128 are prevented from deforming while the geometric features 150 are within the valve 124 (similar to the support provided by the guides 46 of the embodiment of FIGS. 1-3B) whether or not such geometric features are present. Thus, the embodiment of FIGS. 5-7A produces a sequenced or staged opening of the valve lid 126 and all of the benefits provided by such a sequenced or staged opening as discussed above.

Figure 8:
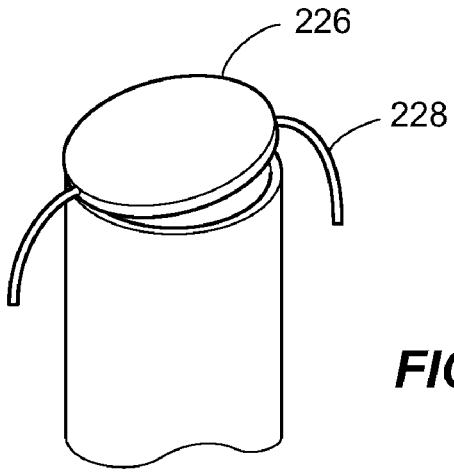
FIG. 8 is a close up perspective view of a first alternate embodiment of a valve and lid.
Figure 9:
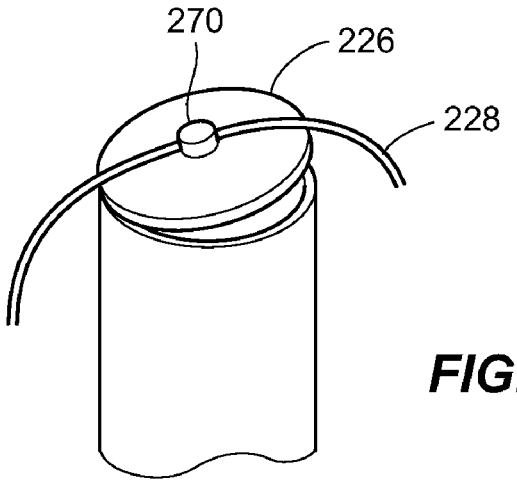
FIG. 9 is a perspective view of a second alternate embodiment of a valve and lid.
Figure 10:
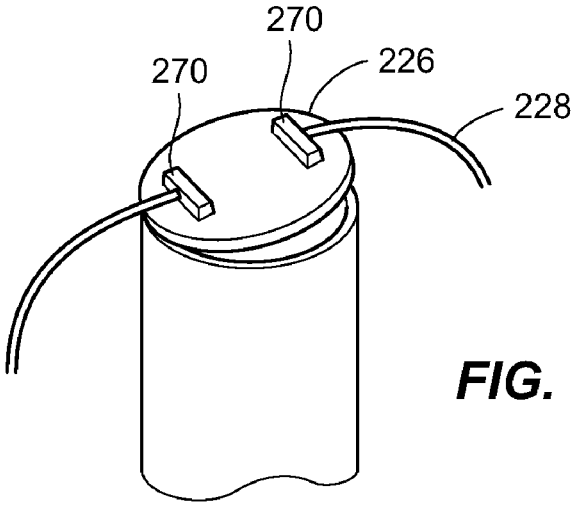
FIG. 10 is a perspective view of a third embodiment of a valve and lid.

FIGS. 8-10 illustrate further alternate embodiments of the lid 226 and actuator arms 228. In these embodiments, the actuator arms 228 are attached to force directing members 270 disposed on a lid 226 (as described in U.S. patent application Ser. No. 12/057,477, which is hereby incorporated by reference) or directly to a side edge of the lid 226. The force directing member 270 may be a tower 270 (FIG. 9) or one or more ribs 270 (FIG. 10). The force directing members 270 reduce deflection of the lid in the closed position. The actuator arms 228 may be attached to the force directing member 270 by any known means, such as snapping, welding, molding, screwing, etc.

Like the actuator arms 28, 128 of previous embodiments, the actuator arms 228 of the embodiment shown in FIGS. 8-10 have the ability to transfer forces, under compression, to the lid 26, 126, 226 such that the lid 26, 126, 226 is substantially solely actuated by the actuating arms 28, 128, 228 and the nib 20, 120 of the writing instrument does not contact the lid 26, 126, 226.

In the closed position, the actuator arms 28, 128, 228 are under tensile forces from the instrument moving mechanism. These tensile forces are transmitted through the actuator arms 28, 128, 228 which "pull down" on the lid 26, 126, 226 thus providing a positive sealing force between the lid 26, 126, 226 and the valve 24, 124, 224. The valve 24, 124, 224, lid 26, 126, 226 and actuator arms 28, 128, 228 may be molded from a single material, or from multiple materials (e.g., a single shot molding process or a double shot molding process). Based on clearances inside of the instrument body, the location at which the actuator arms 28, 128, 228 extend from the lid 26, 126, 226 may be optimized to provide adequate clearance for movement of the actuator arms 28, 128, 228.

As the instrument moving device moves the instrument towards the open (extended) position, the actuator arms 28, 128, 228 experience a change from a tensile force to a compressive force. Because the actuator arms 28, 128, 228 are rigid or semi-rigid, the actuator arms 28, 128, 228 transmit compressive force to the lid 26, 126, 226 thus pushing the lid 26, 126, 226 to the open position before the nib contacts an inner surface of the lid 26, 126, 226. Prior art devices were not capable of transferring compressive forces because prior art devices use flexible actuator arms, such as monofilament string. As the instrument protracts, the actuator arms 28, 128, 228 may bend or bow slightly outward under the compressive force, while still transmitting force under compression from the instrument moving device to the lid 26, 126, 226.

The disclosed embodiments make assembly more efficient and less costly as compared to prior art designs. For example, the disclosed embodiments eliminate the need to melt ends of the monofilament string or otherwise glue the monofilament string to the lid and seat ring. The melting process is difficult to control, very time consuming and expensive. The disclosed one-piece valve door actuating assemblies provide a more efficient assembly process and a more reliable and longer lasting seal between the lid and the valve.

The above disclosed valve lids, valves and actuator arms may be formed from any material that combines limited flexibility with the ability to transfer compressive forces to the valve lid. Such materials include, but are not limited to various materials including but not limited to natural and synthetic rubbers, thermoplastic elastomers, and conventional thermoplastics such as polypropylenes, nylons, etc.

Notwithstanding the disclosure that the actuator arms specifically illustrated herein include a spring to generate opening and closing forces which are transmitted to the lid through the actuating arms, a variety of force generating mechanisms can be used including but not limited to helical springs, leaf springs, etc.

The one-piece valve door assemblies may be used on virtually any instrument having a lid. For example, as will be appreciated by one of skill in the art, one-piece valve door assemblies as described above may be used in various retractable writing instruments such as highlighters, markers, felt-tipped pens, ball point pens, and the like. In addition to writing instruments, the one-piece valve door assemblies are also applicable to a variety of other retractable instruments including paint brush applicators, correction fluid applicators, make-up applicators, such as nail polish and mascara applicators, perfume applicators, thermometers, pH detectors, knives, fluid sampling devices, flash lights, laser pointers, and other instruments. The one-piece valve door assembly is particularly useful for writing instruments such as retractable markers having relatively large writing points as such instruments greatly benefit from the improved seal achieved with the improved valve assemblies described herein. In one aspect, the writing instrument is a permanent marker. In another aspect, the writing instrument may be a dry-erase marker.

Although certain one-piece valve door assemblies have been described herein in accordance with the teachings of the present disclosure, the scope of coverage of this patent is not limited thereto. On the contrary, while the invention has been shown and described in connection with various preferred embodiments, it is apparent that certain changes and modifications, in addition to those mentioned above, may be made. This patent covers all embodiments of the teachings of the disclosure that fairly fall within the scope of permissible equivalents. For example, the rigid or semi-rigid actuator arms may take on virtually any shape and/or size provided that they are capable of transmitting both compressive and tensile forces as described herein. Many other variations of the invention may also be used without departing from the principles outlined above. Accordingly, it is the intention to protect all variations and modifications that may occur to one of ordinary skill in the art.

What is claimed is:

1. An instrument comprising:

an instrument body having an opening at one end;

a valve mounted within the instrument body, the valve having an opening at one end and a lid integrally molded with the valve, the lid being hingedly movable on the valve proximate the opening;

a snap ring operatively coupled to a reservoir holder within the instrument body, the snap ring being separated from the valve; and at least two actuating arms molded to one of the lid and the snap ring, the actuating arms operatively connecting the lid to an instrument actuating device, the instrument actuating device providing force to protract and retract a writing tip through the valve opening by providing force to the actuating arms, wherein upon protraction, the actuating arms transmit forces from the instrument actuating device to the lid under compression and the lid is actuated substantially solely by the actuating arms.

2. The instrument of claim 1, wherein the valve includes at least two stabilizing features and the actuating arms are at least partially disposed within the stabilizing features, the stabilizing features providing lateral support to the portion of the actuating arms disposed in the guides.

3. The instrument of claim 2, wherein the stabilizing features are recessed guides.

4. The instrument of claim 3, wherein at least one of the actuating arms includes a first geometric feature that locally weakens the actuating arm and thereby defines a first location of deformation when the actuating arm is under compression and the geometric feature is above the recessed guide.

5. The instrument of claim 4, wherein the first geometric feature is a portion of the actuating arm that is thinner than the rest of the actuating arm.

6. The instrument of claim 4, wherein the first geometric feature is a notch in the actuating arm.

7. The instrument of claim 3, wherein the actuating arm includes a second geometric feature that locally weakens the actuating arm and defines a second location of deformation when the actuating arm is under compression.

8. The instrument of claim 1, wherein the lid includes at least two openings extending through the lid from a top lid surface to a bottom lid surface, and the actuating arms are extended through the valve and attached to the lid through the openings, thereby protecting the actuating arms from entanglement with the instrument actuating device and securing the actuating arm to the lid.

9. The instrument of claim 1, wherein the snap ring includes a slot and the actuating arm includes first and second stops and the slot is disposed between the first and second stops when the actuating arm is secured to the snap ring.

10. The instrument of claim 9, wherein each actuating arm includes a head at one end and a stop disposed between the head and the snap ring, the head being located on one side of the lid and the stop being located on the other side of the lid.

11. The instrument of claim 1, wherein each actuating arm is molded both to the lid and to the snap ring.

12. The instrument of claim 1, further comprising a force directing component disposed on the lid.

13. The instrument of claim 12, wherein the force directing component is one of a tower disposed on the lid and a rib disposed on the lid.

14. The instrument of claim 1 wherein the instrument is a writing instrument.

15. The instrument of claim 14 wherein the writing instrument is a retractable marker.

16. The instrument of claim 1 wherein the instrument is one of a thermometer, a pH detector, a knife with a retractable blade, a flash light, a laser pointer, and a fluid sampling device.

17. A retractable writing instrument comprising;

a writing member having a nib, the nib extending from an opening in a reservoir holder;

a valve substantially surrounding the opening, the valve having an open end;

a writing member movement mechanism that provides force to move the writing member from a retracted position in which the nib is disposed substantially within the valve to an extended position in which the nib extends outside of the valve through the open end;

a lid integrally molded to the valve and hingedly movable with respect to the opening, the lid being movable from an open position in which the lid exposes the open end of the valve to a closed position in which the lid covers the open end of the valve;

a snap ring operatively coupled to a reservoir holder within the instrument, the snap ring being spaced apart and separated from the valve; and an actuating arm molded to one of the lid and the snap ring, force is being transmitted from the writing instrument movement mechanism to a actuating arm and then the lid under compression during protraction of the nib, wherein the nib does not contact an inner surface of the lid during protraction.

18. The retractable writing instrument of claim 17, wherein the actuating arm includes a geometric feature that locally weakens the actuating arm so that the actuating arm deforms proximate the geometric feature when under compression.

19. The retractable writing instrument of claim 17, wherein the valve includes a stabilizing feature that laterally supports portions of the actuating arm that are disposed within the stabilizing feature.

20. The retractable writing instrument of claim 19, wherein the stabilizing feature is a recessed guide.

* * * * *